US006956792B1

(12) United States Patent
Osborn et al.

(10) Patent No.: US 6,956,792 B1
(45) Date of Patent: Oct. 18, 2005

(54) OPENWORK SHELL PROJECTOR

(75) Inventors: Jason W. Osborn, Amherst, NH (US); Charles P. Wason, Jr., Manchester, NH (US); William S. McNary, Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/085,794

(22) Filed: Feb. 28, 2002

Related U.S. Application Data

(63) Continuation-in-part of application No. 09/326,375, filed on Jun. 4, 1999, now abandoned.

(51) Int. Cl.[7] ..... H04R 1/44
(52) U.S. Cl. ..... 367/174
(58) Field of Search ..... 367/163, 174; 310/337

(56) References Cited

U.S. PATENT DOCUMENTS 5,706,254 A * 1/1998 Stahl ..... 367/163
6,188,313 B1 * 2/2001 Stahl ..... 367/163

FOREIGN PATENT DOCUMENTS

WO WO9532601 * 11/1995 ..... H04R 1/44

* cited by examiner

*Primary Examiner*—Daniel Pihulic
(74) *Attorney, Agent, or Firm*—Daniel J. Long

(57) ABSTRACT

A honeycomb-like shell is provided for an acoustic projector used in sonar applications to increase the bandwidth of the projector, reduce its weight, and to provide increased power density and reduced shell costs. The shell has outer and inner layers, with the honeycomb structure therebetween. The honeycomb shells have application in slotted cylindrical projectors, flextensional projectors, inverse flex tensional projectors, and oval-shaped projectors in which the honeycomb structure replaces the solid shells, with the honeycomb providing the relatively high specific stiffness required for the acoustic properties of the projector. The honeycomb shell achieves the same bending stiffness of the solid shells with less weight through the utilization of radial stiffeners between the inner and outer layers. The use of the honeycomb structure increases bandwidth by over 30%, and reduces total weight by 22%, shell weight by 65% and shell cost by 50%, making the honeycomb shell ideal for low frequency sonar applications.

13 Claims, 6 Drawing Sheets

OPENWORK SHELL PROJECTOR

CROSS REFERENCE TO RELATED APPLICATION

This is a continuation-in-part of U.S. patent application Ser. No. 09/326,375 filed Jun. 4, 1999, now abandoned.

BACKGROUND OF THE INVENTION

1. Field of the Invention

This invention relates to acoustic projectors and more particularly to a projector having an openwork honeycomb-like shell.

2. Brief Description of Prior Developments

Low frequency flexural sonar projectors have been developed for a variety of subsea and seismic prospecting applications. Several types of projectors which have been developed over time include flextensional projectors, inverse flextensional projectors, slotted cylinder projectors, oval-shaped projectors and others. The type of projector selected for a specific application has been dependent on the specific application requirements. Typical requirement parameters are source level, frequency, size, weight, bandwidth, efficiency and operating depth. Generally, projector development has evolved to produce low frequency sonar at greater source levels, bandwidths and efficiencies in a smaller lighterweight package for greater ranges of depths.

Current emphasis is on weight and cost reduction while maintaining or enhancing acoustic performance. There is thus a need for lower cost sonar projectors that weigh less than current projectors, with reduced weight allowing for a sonar system to be installed on smaller more agile ships that provide greater options when deploying the acoustic projectors.

Importantly, in the field of low frequency sonar projectors, nearly all projector shells used to date have been solid, and have been made of materials such as aluminum, steel, fiberglass and graphite composites. Recent sonar development has focused on the use of graphite composites because of desirable acoustic properties attributed to its relatively high specific stiffness. However, grades of this composite material best suited for sonar applications are expensive. There is thus a requirement for a structure in which the volume of material is reduced which results in lower material cost.

Moreover, there is a need for lighter projectors in general for ease of storage and development so that projector arrays can be carried aboard smaller and smaller vessels. Assuming satisfactory acoustic properties, lighter shells can give rise to either higher power density projectors or conversely a lighter weight projector for the same power output. Additionally, there is a need for greater bandwidth so as to increase resolution to permit finer target identification or application to a wide range of sonar return measuring scenarios. There is also a need for lower cost materials, such as aluminum, that can be configured to provide the equivalent stiffness of a solid graphite composite structure.

More generally, as a result of changing world political and military alignments, mobile surveillance naval operating forces face an increased requirement to carry out low frequency active, LFA, missions. Lightweight miniaturized acoustic sources that enhance mission effectiveness by increasing area searched at reduced cost are thus extremely desirable. These sources also need to have wide frequency bandwidth, high reliability, and high acoustic power densities, and must be affordable to meet their area search requirements.

The potential for dramatically increasing the acoustic power density of low frequency active sonar has already been demonstrated by slotted cylinder projectors with power densities of approximately 300 watts/Kg-KHz-Qm. Further, acoustic power densities of up to 800 watts/Kg-KHz-Qm are possible with slotted cylinder projectors configured with high strain lead magnesium niobate ceramic material. These greater projector power densities allow for greater sonar system and mission flexibility such as greater detection ranges, bandwidth, source miniaturization, weight and size reductions.

Recently, slotted cylinder projectors have operated at various electric fields and stresses in excess of 100 million cycles, a significant achievement over the previous state-of-the-art devices. Generally the slotted cylinder projectors have mechanical quality factors, Qm's of 5–6, where Qm=freq of resonance divided by the difference in frequency of the one-half power frequencies. Lower Qm's are desirable to accommodate a wide range of frequencies, and have been achieved by clustering projectors in close proximity. However, for towed projector arrays used for either surveillance or tactical missions, this can result in increasing the frontal drag area of the projector cluster which can limit tow speeds due to increased drag loads, or result in reduced mission duration due to higher fuel consumption. If one could enhance the bandwidth of the single element projector, one could reduce the need for clustering and the attendant hydrodynamic issues. With reduced drag, operating speeds can be increased, increasing the area searched and improving mission effectiveness. While reducing the number of projectors minimizes array drag, there is also a need to reduce the weight of the projectors, as well as minimizing the need for heavy array stabilizers so that the projectors can be stored on even smaller craft.

SUMMARY OF THE INVENTION

The present invention is an enhanced bandwidth lightweight, inexpensive projector achieved through the use of a lightweight openwork honeycomb projector shell. It has been found that not only is this honeycomb structure sufficiently rigid to approximate a solid shell, the bandwidth is increased by as much as 30%. The result of using an openwork structure is lower weight and increased power density, with a concomitant reduction in shell cost.

The term "honeycomb" as used herein, describes an open-work, mesh-like structure between inner and outer layers that can take the form of a truss, ribs, flanges, or expanded material which increases the shell stiffness-to-weight ratio. In one embodiment, the shell has a smooth continuous surface on the inner diameter to mate to the ceramic driver and on the outside diameter to mate with the waterproof boot. The above-mentioned openwork honeycomb structure is then sandwiched between these continuous surfaces. The honeycomb material may be a cast metallic truss which can be produced in any shape or truss style from castable material. The advantage of this material is that it can be produced at exceptionally low cost, more than an order of magnitude less when considering solid graphite composite shells.

Another shell is one involving radial composite ribs for load transfer from the inner to outer shell surfaces. This is analogous to the spars in an airplane wing. The construction is straightforward, in which the components are made from a unidirectional tape and then laminated together. The fabrication time to make a shell using this approach versus a solid filament wound or tape lay-up shell is significant, not to mention the reduction in raw material. This honeycomb technique also allows the use of much lower cost fibers than the typical high modulus graphite. Note that alternative materials include so-called s-glass.

Thus, the openwork shell can take on a number of configurations such as truss structures, radial web stiffeners, and honeycomb octagonal configurations, and can use materials such as cast aluminum, brass or titanium, graphite composite, s-glass composite, graphite/s-glass composite hybrids and aluminum/graphite composite hybrids.

While the openwork shells can be used in a large variety of projectors such as flextensional, inverse flextensional and oval-shaped, there is special application in slotted cylindrical projectors. In one embodiment, a slotted cylinder projector shell is made of an openwork honeycomb or lattice of high modulus graphite, for the greatest bandwidth. Note that the high modulus graphite composite shell can be provided in either a tapered or uniform configuration. This has been shown to out-perform, in terms of bandwidth, denser aluminum and steel shells. Tests have shown that projector bandwidth improvements of up to 30%, and projector weight reductions of greater than 20% can be achieved with the lighter weight honeycomb shell. The honeycomb shell also has the advantage of lower cost.

It will be appreciated that the graphite shell is the single most expensive component of an acoustic projector, and represents approximately 30% of projector cost. The honeycomb shell removes 70% of the shell weight resulting in significant weight, cost and shell assembly time savings. Although some portion of the shell fabrication cost is increased in preparing the honeycomb structure, overall there is a net savings, especially due to the reduced volume of material.

The weight savings associated with this honeycomb shell material can also be effectively allocated to increased radiating area, further increasing bandwidth. Thus, for the same overall projector weight, bandwidth can be increased by 40–50%.

Slotted cylinder projectors are one of the few transduction devices that have demonstrated the ability to be re-engineered for different mission areas. Although flextensional and bender disc transduction devices have demonstrated the ability to transition to multiple missions, only the slotted cylinder projector technology has the broadest application to multiple mission platforms where low frequency active devices are needed. The slotted cylinder projector's greatest asset is its shape, which is an excellent hydrodynamic shape for towing, and ideal for air-launched and sub-launched devices. Moreover, the slotted cylinder projector provides the lowest resonance for a given diameter and the interior is available for packaging of electronics or pressure compensation for deep depth missions to 1,000 meters. The slotted cylinder projector compact shape and efficient energy transfer results in a high power density on a weight and volume basis.

Since the slotted cylinder projector technology debut for military applications in 1987, the technology development has evolved and enhanced from an original short-life expendable air-deployed sonobuoy mission to a long-life and powerful surveillance mission. With this evolution has come a dramatic increase in the number of applications and missions. With the honeycomb shell for bandwidth enhancements, the use of this shell improves the suitability of slotted cylinder projectors for multiple missions and platforms.

The subject openwork shell thus results in a new generation of projectors that have greater bandwidth, increased power density, lower cost, reduced size and weight while preserving the demonstrated reliability and linearity.

More specifically, increased bandwidth is desirable because it enables longer low frequency and high frequency sweeps and increased frequency diversity. It also, allows for enhanced waveform techniques, important features for target resolution and classification. This is beneficial for surveillance, tactical and airborne systems. Since the honeycomb shell reduces projector weight, one way to leverage this dividend is to exchange the weight reduction for a larger projector with more radiating area. Because acoustic power is proportional to radiating area squared, increased acoustic power can be generated. Note that lengthening the projector also increases bandwidth. This would be an appropriate use of the weight savings for a surveillance or tactical application.

For an airborne application, weight savings in the projector can be applied to the power amplifier to increase power output capability, or applied to the battery to increase life or prime power capability.

A lower cost projector, always a desirable feature, is of greatest benefit for high volume applications where recurring cost is a high percentage of total cost, such as a sonobuoy application.

As mentioned, clustering of elements results in an increased bandwidth relative to a single element. The honeycomb shell either obviates the need for clusters; or if applied to a cluster configuration, further enhances bandwidth. Thus, the dividends of the open work structure can be used differently, depending on the mission and platform.

Note, the use of a honeycomb structure does reduce shell weight, but does not increase resonance. The reason is that as the effective density is reduced by honeycombing, generally, the effective modulus is reduced nearly by the same proportion. Hence the ratio of modulus to mass is unchanged, and resonance is constant. This is dependent on specific shell geometry and ceramic volume. Moreover, careful placement of stiffeners and mass, such as at the shell tip, yields desirable results. Additionally, thicker honeycomb shells, relative to solid shells, have the added benefit of lower hydrostatic induced stresses.

In summary, a honeycomb-like shell is provided for an acoustic projector used in sonar applications to increase the bandwidth of the projector, reduce its weight, and to provide increased power density and reduced shell costs. The shell has outer and inner layers, with the honeycomb structure therebetween. The honeycomb shells have application in slotted cylindrical projectors, flextensional projectors, inverse flextensional projectors, and oval-shaped projectors in which the honeycomb structure replaces the solid shells, with the honeycomb providing the relatively high specific stiffness required for the acoustic properties of the projector. The honeycomb shell achieves the same bending stiffness of the solid shells with less weight through the utilization of radial stiffeners between the inner and outer layers. The use of the honeycomb structure increases bandwidth by over 30%, and reduces total weight by 22%, shell weight by 65% and shell cost by 50%, making the honeycomb shell ideal for low frequency sonar applications.

BRIEF DESCRIPTION OF THE DRAWINGS

These and other features of the Subject Invention will be better understood in connection with the Detailed Description in conjunction with the Drawings of which.

DETAILED DESCRIPTION

Figure 1:
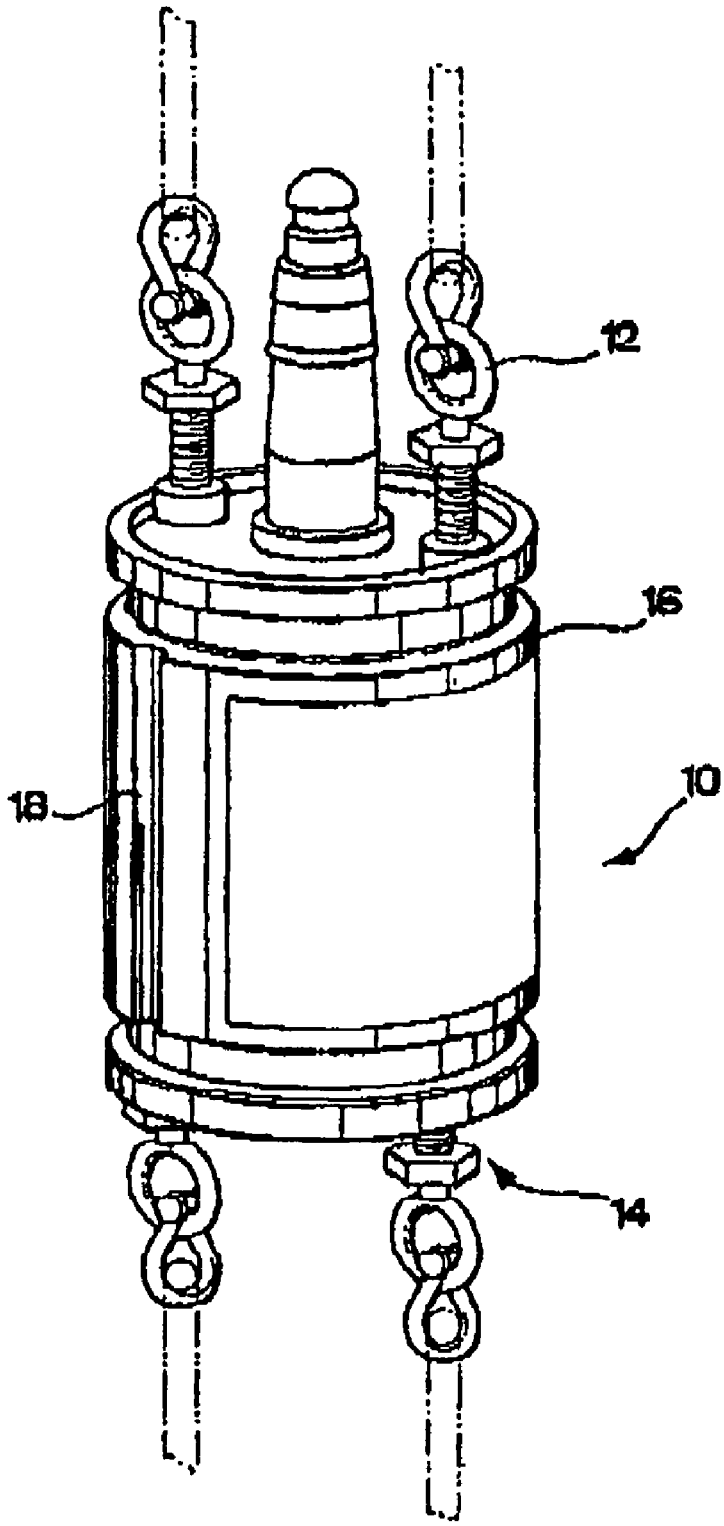
FIG. 1 is a diagrammatic illustration of a slotted cylinder projector for use in sonar applications indicating a unit sealed with a watertight boot and oriented for projecting acoustic radiation in a lateral direction.

Referring now to FIG. 1, a slotted cylinder projector 10 is shown being suspended at its top through a chain and cable assembly 12 and at its bottom through a similar assembly 14, in which the slotted cylinder projector shell is provided with a boot 16 which surrounds the body of the projector. As can be seen, there is a slot 18 in which boot 16 descends to provide for the flexural movement of the sides of the cylinder as it is driven by transducer drive elements.

Figure 2:
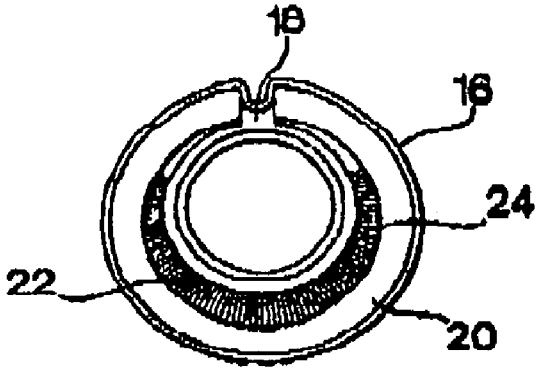
FIG. 2 is a cross-sectional view of the projector of FIG. 1 illustrating the slotted shell and placement of transducer drive elements in opposition to the slot.

As can be seen from FIG. 2, one of the projector elements is shown in cross-section in which boot 16 surrounds a solid shell 20, in which shell 20 is provided with slot 18 into which the boot descends.

Opposite slot 18 are a series of ceramic drive elements 22 which are positioned at the inner surface 24 of shell 20 such that when activated, the walls of the shell move thus to provide the low frequency acoustic radiation.

Figure 3:
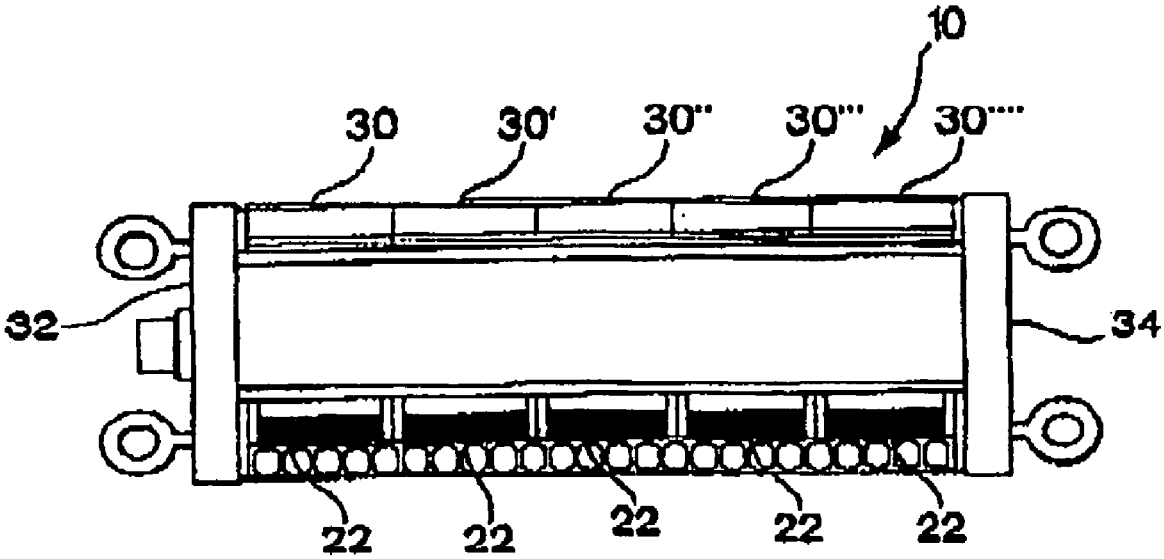
FIG. 3 is a cross-sectional view of the projector of FIG. 1 showing a stacked array of drive elements.

As illustrated in FIG. 3, in one embodiment, projector 10 is comprised of a number of like-configured projector elements 30, 30 I, 30 II, 30 III, and 30 IIII, which are arranged between end portions 32 and 34 in a stacked array. As can be seen in this figure, the ceramic drive elements are exposed to show their relationship one to the other and to the shell such that when the elements are driven in parallel, an exceedingly efficient introduction of acoustic energy into the surrounding water is achieved.

As mentioned hereinbefore, the slotted cylinder projector has a number of advantages, not the least of which is the amount of power that can be projected into the surrounding water.

Figure 4:
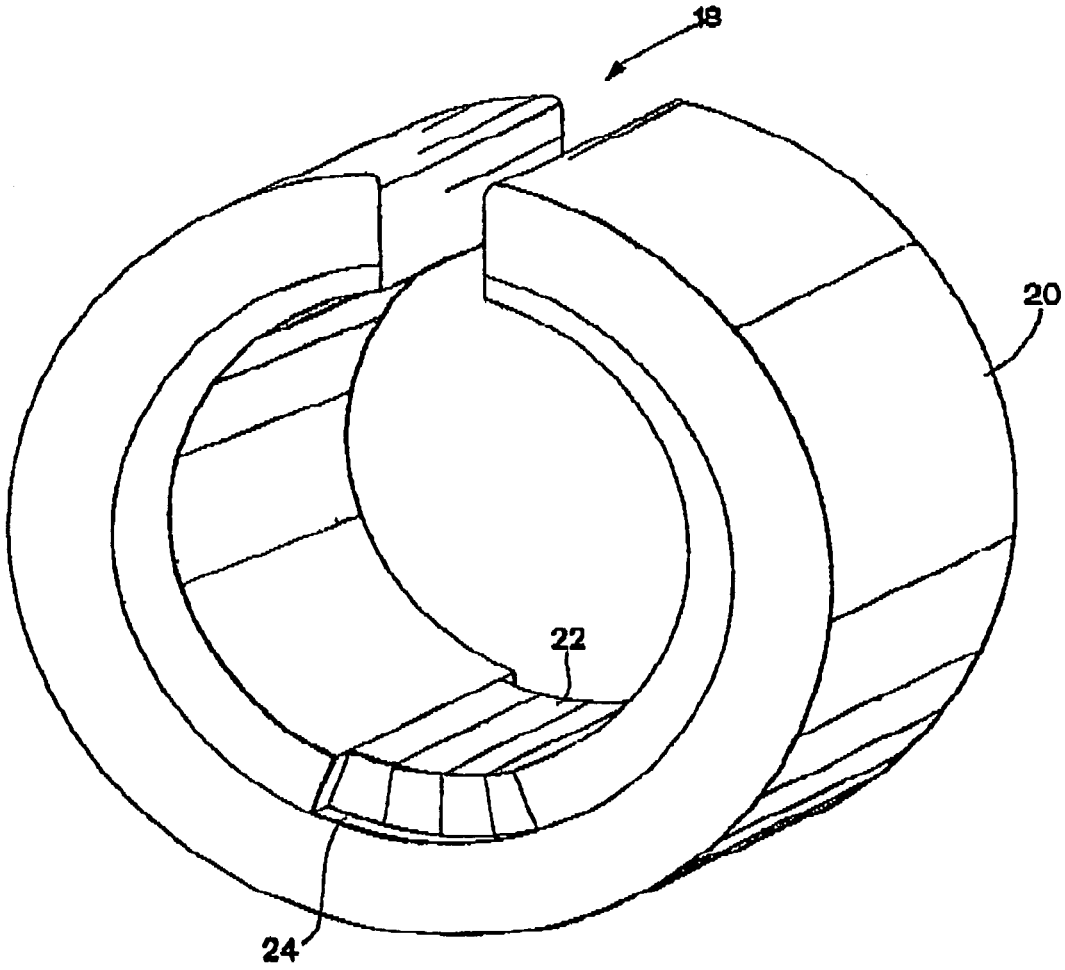
FIG. 4 is diagrammatic representation of a slotted cylinder projector element of FIG. 3, illustrating the positioning of the drive elements and the slot for the shell.

As illustrated in FIG. 4, one of the projectors is shown in an isometric view in which shell 20 is shown to have the aforementioned slot 18, with the ceramic drive elements 22 lying adjacent inner surface 24 of shell 20.

As discussed hereinbefore, typically the shells utilized in the past have been of solid material and as such suffer not only from cost and weight considerations, but also from a lack of bandwidth. Moreover, when these solid structures resonate, they resonate at a well defined frequency which precludes broadening the bandwidth of the projector.

Figure 5:
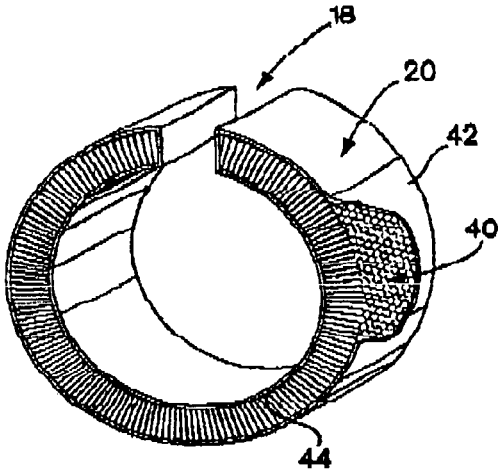
FIG. 5 is a diagrammatic and sectional view of one embodiment of the openwork honeycomb shell used in place of the solid shell for the slotted cylindrical projector of FIG. 4 in which the honeycomb structure is provided by a honeycomb arrangement of hexagonal cross-sectioned stiffeners between the inner and outer layers of the openwork structure.

Referring now to FIG. 5, rather than providing a shell for the projector in solid form as can be seen, a honeycomb openwork structure 40 is positioned between an outer layer 42 and an inner layer 44. In this embodiment, the openwork structure 40 is in the form of a traditional honeycomb which provides stiffening between the inner and outer layers of the shell.

It has been found that not only is less material utilized, reducing the weight and the cost of the shells, the stiffness imparted by the openwork structure between the inner and outer layers of the shell is sufficient to provide for the same structural rigidity as that of a solid shell, while at the same time increasing the bandwidth at which the projector can operate.

One of the reasons that the bandwidth is increased is because the moving mass of the shell is reduced. By providing an openwork stiffening structure between the inner and outer layers of the shell as illustrated in the FIG. 5 embodiment, the mass relative to a solid shell is reduced. This means that rather than having a of 5–6, the of the shell is reduced by approximately 30%.

Figure 6:
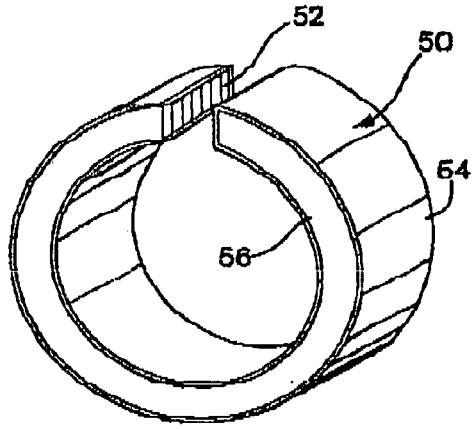
FIG. 6 is a diagrammatic illustration of the subject openwork shell illustrating walled channels serving as stiffening elements between inner and outer layers.

Referring now to FIG. 6, the same types of advantages can be achieved for the shell illustrated in FIG. 6 at 50 in which the stiffening structure 52 between outer layer 54 and inner layer 56 of the shell is made up of walled channels which can take on any form as opposed to the octagonal-shaped ribs for the openwork structure of FIG. 5.

Figure 7:
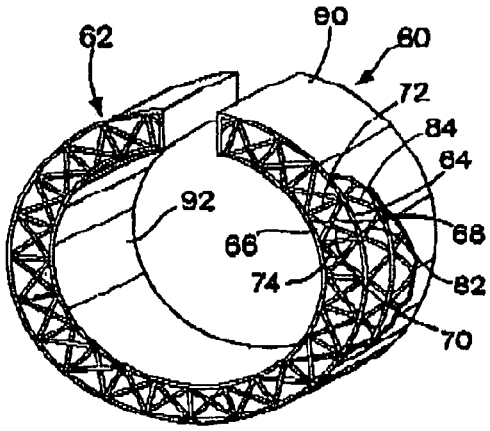
FIG. 7 is a diagrammatic and cross-sectional view of an openwork structure in which a lattice having ribs or struts for providing the stiffening between inner and outer layers of the shell.

Referring now to FIG. 7, a shell 60 is shown as having an openwork structure 62 which is in the form of a lattice work in which paralleled outer rings 64 and inner rings 66 or members are spaced apart and have struts 68 and 70 which run diagonally, and struts 72 and 74 which run octagonal between the inner and outer layers. In one embodiment, these struts run radially between the layers.

Additionally, as illustrated at 82 and 84 there are diagonal struts running between the rings such that a geodesic structure is formed, which is an openwork structure in which the structural rigidity is provided by the struts between the rings. As illustrated, the rings have an outer layer 90 and an inner layer 92. The stiffness afforded by the open latticework truss structure of FIG. 7 is equivalent to that of a dimensionally equivalent solid shell, but also has the associated increased bandwidth characteristics which make the slotted cylinder projector utilizing these shells even more adaptable to a variety of different missions.

Figure 8:
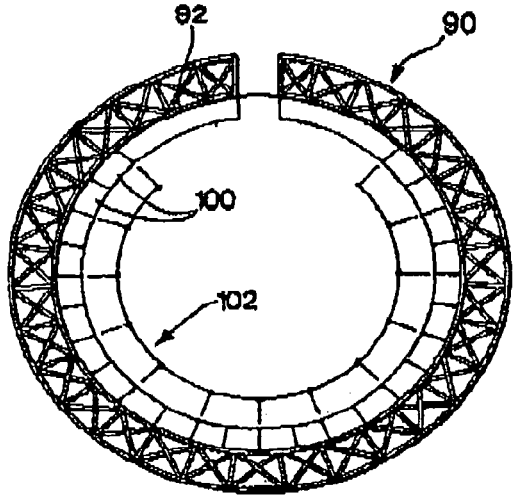
FIG. 8 is a diagrammatic and cross-sectional view of a projector utilizing the shell of FIG. 7, showing the positioning of piezoelectric drive elements within the shell.

Referring now to FIG. 8, it can be seen that shell 90 has a series of transducer drive elements 100 spaced about the inner periphery of the shell at surface 92. The elements are powered by electrical connections, generally illustrated at 102, which provide alternating voltages across these elements to operate the elements in a flexural mode. As is typical, the modes are the $d_{33}$ and the $d_{31}$ modes.

Figure 9:
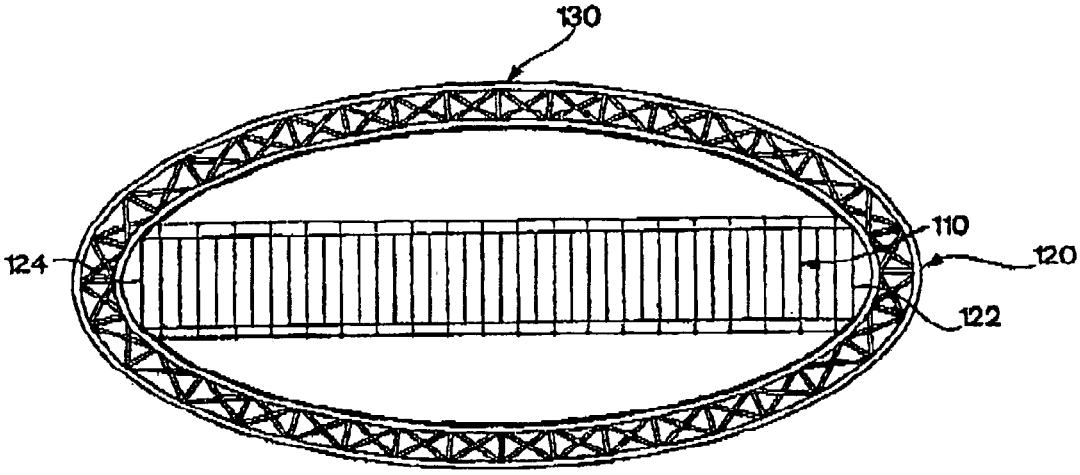
FIG. 9 is a diagrammatic and cross-sectional view of a flextensional projector in which the shell is provided with the openwork structure of FIG. 7.

Referring now to FIG. 9, the openwork shell can be utilized in a so-called flextensional projector in which a stack of ceramic drive elements 110 is positioned within an oval-shaped shell 120, with the oval-shaped shell being provided by the pressure of the ends 122 and 124 of the stack against the shell. The shell vibrates by virtue of the longitudinal expansion and contraction of the drive elements such that the shell walls move inwardly and outwardly.

In this embodiment, the shell, rather than being solid, is made of an openwork structure, here illustrated as the open lattice truss-type structure of FIG. 7. Here the open lattice work structure is shown at 130 and has the aforementioned struts running between rings and radially extending ribs.

Figure 10:
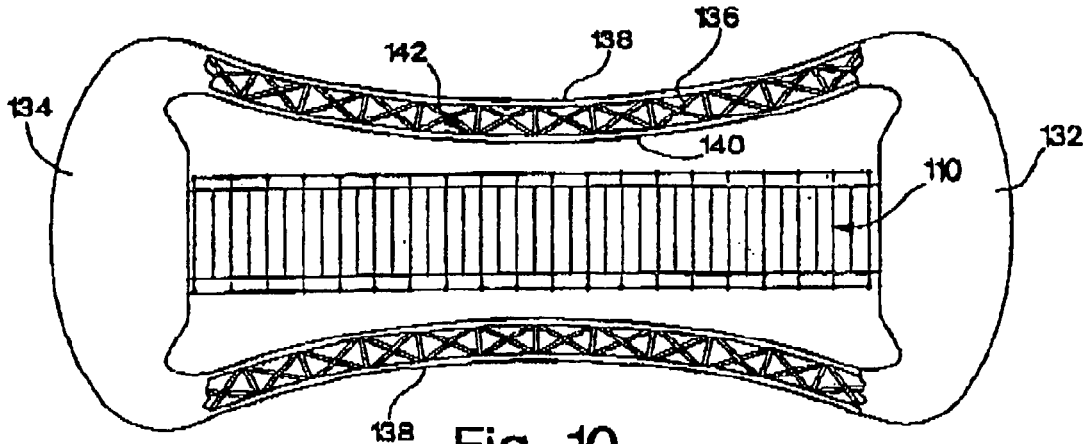
FIG. 10 is a diagrammatic and cross-sectional view of an inverse flextensional projector in which the shell is made with the openwork structure of FIG. 7.

Referring now to FIG. 10, an inverse flextensional projector is shown in which the stack 110 is positioned between ends 132 and 134 of a shell in which the walls 136 and 138 of the projector are initially formed so as to bend inwardly as illustrated. Upon longitudinal expansion of the stack with drive current, the middle positions of the walls 136 and 138 move outwardly. Rather than having these walls configured in a solid manner, in the instant case, an openwork structure is used in which outer and inner layers 138 and 140 have openwork structure 142 positioned therebetween.

Figure 11:
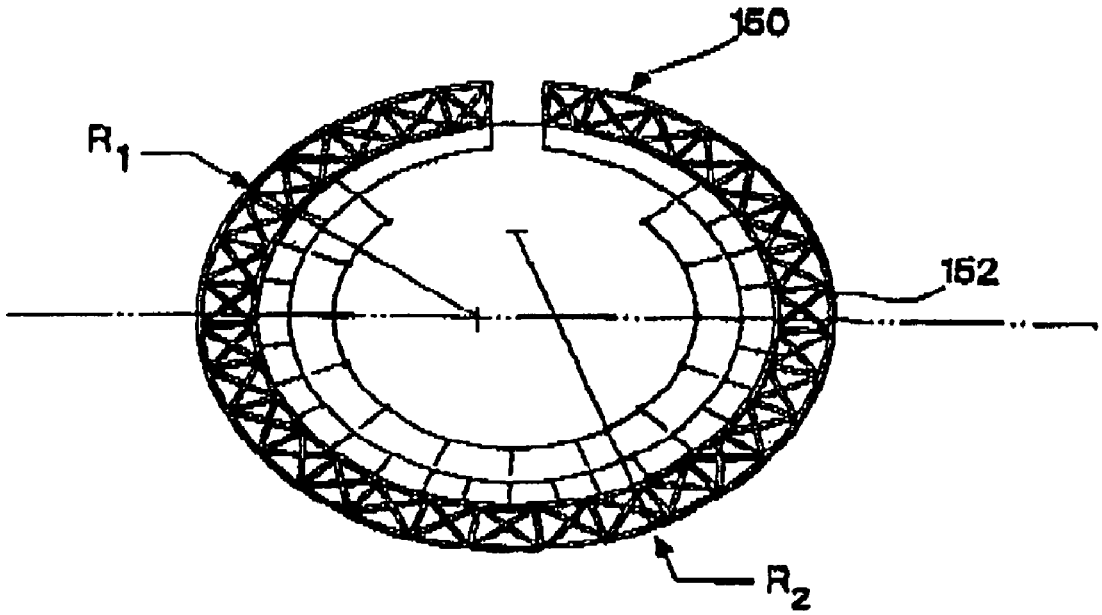
FIG. 11 is a diagrammatic and cross-sectional view of an oval projector in which the shell is made with the openwork structure of FIG. 7.

Referring now to FIG. 11, while a slotted cylindrical projector has been described hereinbefore, it is possible to form such a projector in an oval-shape such as illustrated in FIG. 11 at 150, in which the shell 152 is made of the aforementioned openwork structure.

The significance of the oval projector is that the radius in the horizontal direction for the shell is greater than the radius in the vertical direction, with the oval nature of the shell providing for less stress within the shell.

What has therefore been described is a number of applications for an openwork structure shell which is honeycomb in nature in that the shell is provided with an outer layer and inner layer, with an openwork structure sandwiched therebetween. The openwork structure not only reduces weight and cost, but also provides for increased bandwidth, while at the same time maintaining sufficiently equivalent structural rigidity that the acoustic properties of the projector are not significantly altered over the solid shell, with the exception of the aforementioned increased bandwidth.

The utilization of an openwork structure for the shell in increasing the bandwidth obviates the necessity for the aforementioned clustering to provide bandwidth and provides an increased acoustic power output.

Having now described a few embodiments of the invention and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. A shell for an acoustic projector for use in sonar applications, comprising:

an openwork structure;

an outer layer on one side of said structure and adapted to provide the interface between said projector and the surrounding water; and an inner layer on a side of said structure opposite said one side and adapted to carry transducer drive elements thereat, whereby said projector is provided with an increased bandwidth over that associated with equivalent solid shells, which is in a form of a series of co-located walled channels, which is in a form of a truss.

2. The shell of claim 1 wherein said openwork structure is in the form of an open lattice work.

3. The shell of claim 2 wherein said open lattice work includes parallel spaced members at both said inner and outer layers, a number of spaced struts running between said parallel spaced members in a direction orthogonal thereto, and a number of stiffening struts, each running between a point of attachment between the parallel spaced members and said struts.

4. The shell of claim 1 wherein said openwork structure provides a stiffness at least equal to that achievable with an equivalent solid structure.

5. The shell of claim 1 wherein said projector is a slotted cylinder projector.

6. The shell of claim 1 wherein said projector is a flextensional projector.

7. The shell of claim 1 wherein said projector is an inverse flextensional projector.

8. The shell of claim 1 wherein said projector is an oval-shaped projector.

9. A method of increasing the bandwidth of an acoustic projector for use in a wide variety of sonar applications comprising: providing an acoustic projector having an openwork shell, the shell having an openwork structure sandwiched between inner and outer layers, wherein the projector is a slotted cylinder projector.

10. The method of claim 9 wherein the projector is a flextensional projector.

11. The method of claim 9 wherein the projector is an inverted flextensional projector.

12. The method of claim 9 wherein the projector is an oval-shaped projector.

13. A method of increasing the bandwidth of an acoustic projector for use in a wide variety of sonar applications comprising: providing an acoustic projector having an openwork shell, the shell having an openwork structure sandwiched between inner and outer layers, wherein the projector is an inverted flextensional projector.

* * * * *